US006299172B1

(12) United States Patent
McMurray

(10) Patent No.: US 6,299,172 B1
(45) Date of Patent: Oct. 9, 2001

(54) GAME WITH THROW PIECES AND A VARIABLE TARGET ASSEMBLY

(76) Inventor: Larry Daniel McMurray, 18134 6th Pl. SW., Normandy Park, WA (US) 98166

( * ) Notice: Subject to any disclaimer, the term of this patent is extended or adjusted under 35 U.S.C. 154(b) by 0 days.

(21) Appl. No.: 09/638,204

(22) Filed: Aug. 11, 2000

Related U.S. Application Data

(63) Continuation-in-part of application No. 09/227,435, filed on Jan. 8, 1999, now abandoned.

(51) Int. Cl.[7] ..... A63F 9/02
(52) U.S. Cl. ..... 273/348.4; 273/DIG. 30
(58) Field of Search ..... 273/348, 348.2, 273/348.3, 348.4, 348.5, 354, 410, DIG. 30; 473/573

(56) References Cited

U.S. PATENT DOCUMENTS 4,055,343 * 10/1977 Stuart ..... 273/108
5,358,742 * 10/1994 Ziff ..... 273/348.4 X
6,116,605 * 9/2000 Davey, III ..... 273/348.3

* cited by examiner

*Primary Examiner*—Raleigh W. Chiu
(74) *Attorney, Agent, or Firm*—Mark Zovko

(57) ABSTRACT

An indoor/outdoor game in which toy pieces are thrown to a target. The toy pieces and target are covered with hook and loop material so that contact of the toy piece and target results in adherence of the toy piece and target. Boundary and point marker pieces are also provided. A high degree of creativity is allowed the player as they can determine target zones, point values of those zones, and target shapes. The target can be collapsed and provided with handles and zipper to form a carrier for the toy pieces and prevent separation of the toy pieces from the game during transportation or storage.

20 Claims, 5 Drawing Sheets

GAME WITH THROW PIECES AND A VARIABLE TARGET ASSEMBLY

CROSS RELATION TO OTHER APPLICATIONS

This application is a continuation - in-part of U.S. Ser. No. 09/227,435 filed Jan. 8, 1999 now abandoned.

BACKGROUND OF THE INVENTION

1. Field of the Invention

This disclosure relates in general to a game with throw pieces and more particularly to a game having a variable target and throw pieces which can adhere to each other upon contact.

2. Description of the Prior Art

The prior art has a host of games which involve projectiles of one form or another and a target For instance, U.S. Pat. No. 5,452,902 issued to Foster et al, shows an action game in which balls covered with hook and loop material are thrown at discs having the same material on the outside. If the ball strikes the disc in a flush manner, the disc sticks to the ball and a game can be played using the discs as points. It may be useful to contrast this patent with the present invention. The present invention, unlike Foster et al, allows for the players to determine boundary zones on a target surface and assign those zones point values. This variable target element allows a degree of creativity from the players in shaping the boundaries of the game which is not present in the known prior art. In an alternative embodiment, the target includes an upright member and base member which can result in the target tipping over on being struck by a throw piece. The degree of sensitivity to tipping over is controlled by the player. In summary, as will become clear in the following description, a challenging, safe, and fun game is provided which is distinct from the prior art.

SUMMARY OF THE INVENTION

The game of the present invention has a throw piece or panel covered at least partially with a hook and loop material which is thrown at a compatible target also having a hook and loop covering. More than one throw piece can be provided. The throw pieces can be of any shape and may be relatively flat (two dimensional) or more three dimensional such as a cube, star or sphere. The throw pieces can adhere to each other so that an individual throw piece or a plurality of connected pieces can be thrown toward the target. In addition to the throw pieces, a plurality of boundary pieces are also provided. The boundary pieces have hook and loop material or hook and loop tape on their surface and can be arranged on the target to produce a boundary zone which is assigned a point value for the players. The players, therefore, can create varied boundary or target zones on the target surface, each assigned a given point value by mutual agreement. A set of point marker. pieces is also provided which can be used to identify the value of the boundary zones created by placing the marker piece (also having a hook and loop material on its surface) within or adjacent to the boundary zone. When a throw piece lands in a boundary zone on the target surface the point value credited to that player is determined by the marker piece. The marker pieces can be negative in value so that a throw piece landing on a boundary zone with a marker piece having a negative point value results in a deduction of points from the throwing player's total score. The players can typically use up to ten throw pieces in a single game. After all the pieces are thrown in turn by each player, the points awarded for the tossed pieces landing in the boundary zones are tabulated and the player with the most points is the winner. The throw pieces can also be combined so that two or more throw pieces can be tossed at the target at one time. Also, as a variation the marker pieces can be thrown at the target by the players to determine the point value of a target zone after all throw pieces are tossed.

The target surface is adapted to be positioned either horizontally or vertically. The construction of the target is such that it can be collapsed and used as a carrying tote with the throw pieces, boundary pieces, and marker pieces contained within. Alternatively, the target can be made flexible for folding or rolling thereby providing a versatile one-piece storage. Handles can be provided at appropriate places on the target which facilitates transportation of the game without losing any of the various pieces.

In an alternative embodiment of the game, an upright structural member which preferably can vary in length is provided. This upright structural member supports the target surface which adheres thereto or forms a target surface itself. Boundary zones then can be created on the target surface as described previously. The upright structural member is mounted in a base member which contains a material that is relatively heavy, thereby serving as a counter weight to the upright structural member. The target can be varied in height by lengthening or shortening the structural member. Given this configuration, it is obvious that a "taller" target will be able to tip over more easily due to its higher center of gravity. Additional rules using the "tip over" target can be provided. For example, if the target tips over or touches the ground, the game ends with players forfeiting any remaining throw pieces. The scores are added up at this point and a winner determined. As another example, a tipped over target can result in forfeiture of the throw of the offending player. The entire variable target assembly can be placed on the ground or it can be made with buoyant materials and floated in a pool of water.

In each of the above described embodiments (static target or variable target assembly) a great latitude is provided for the players to agree on the rules of the game. As a further example, the players can throw pieces at an unmarked target surface having no boundary zones with the intention of grouping a plurality of throw pieces in a given area. The marker pieces can then be thrown by the players after all of the throw pieces are on the target surface. For instance, the player with the most pieces in a given area can throw a marker piece which will give a point value to those pieces if it hits that target area. If the marker piece misses the target area, the next player can throw the marker piece to identify the scores of the throw pieces.

The object of the present invention is to provide a challenging, creative throw game as described above which is a safe indoor or outdoor game. The game can be easily kept clean or sanitized and used around sand or water without damage to the various pieces or the surrounding environment.

These and other objects and advantages of the present invention will become more apparent from the following detailed description when taken in conjunction with the attached drawings.

DESCRIPTION OF THE PREFERRED EMBODIMENT

Figure 1A:
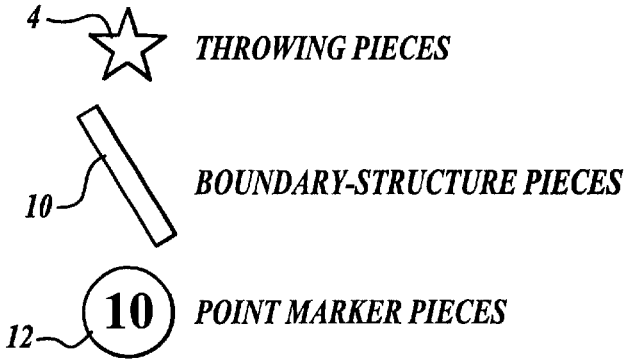
FIG. 1A and 1B are front views of the game of the present invention showing the target hanging vertically and the pieces used in the game.
Figure 1B:
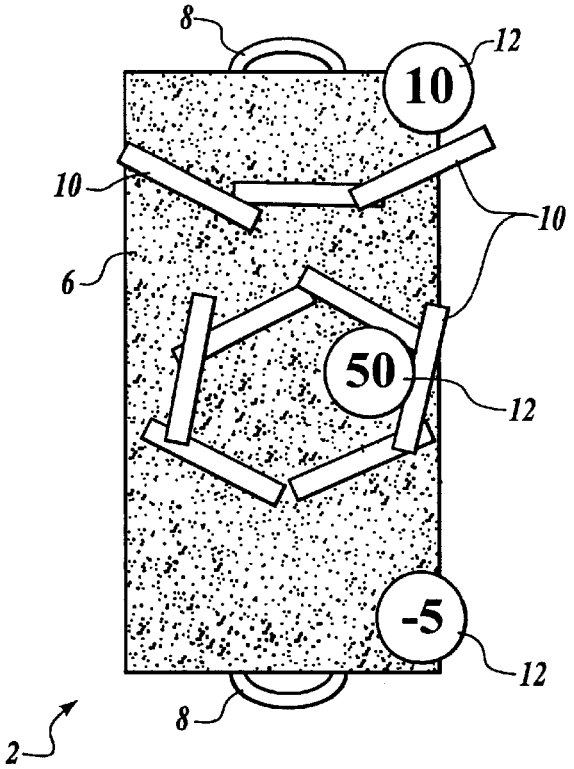

Referring to the Figures, especially Figures 1A and 1B, a game is shown having a target 2 and throw pieces 4. The target can be mounted vertically on a door, for instance, in an indoor setting, or on a tree in an outdoor setting. The throw pieces 4 consist of a panel with a hook and loop material attached thereto on at least pan of the panel's surface. The target 2 has an outer material on the target surface 6 compatible with the hook and loop material of the throw piece 4, such as hook and loop material itself, so that contact between the throw piece 4 and target surface results in adherence of the piece 4 to the target surface 6. The target 2 has handles 8 which can be used when mounting or transporting the target 2. The game also includes boundary structure pieces 10 which can be used to form a boundary zone on the target surface 6. The boundary structure pieces 10 have a hook and loop material attached thereto which is compatible with the target surface thereby allowing the boundary structure pieces to cling to the surface 6 when placed on that surface. It can be readily seen that the boundary zones are easy to form and change by the players which adds a creative dimension to the game. To mark the value of determined boundary zones, point marker pieces 12 are provided which can be placed or thrown onto the target surface 6 within or adjacent to the given boundary zone as shown best in FIG. 1B. As shown on that figure, the value for the boundary zones can be set as a positive number, allowing the given number of points to be added to the players score, or can be a negative number which is subtracted from the player's total score.

Figure 2A:
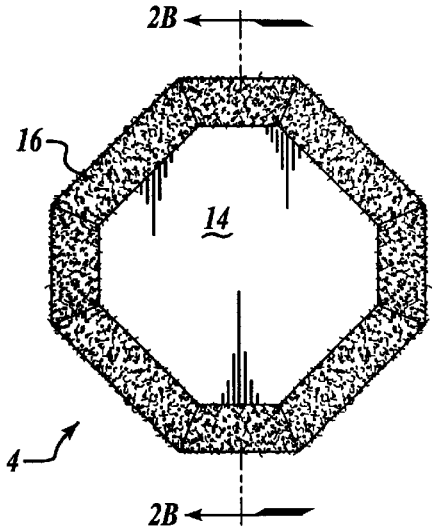
FIG. 2A show a front view of a throw piece used in the game of the present invention.
Figure 2B:
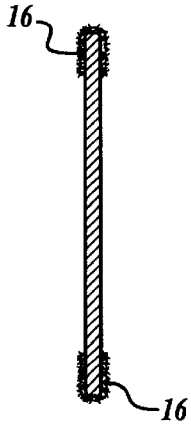
FIG. 2B is cross section through line A—A of FIG. 2A
Figure 2C:
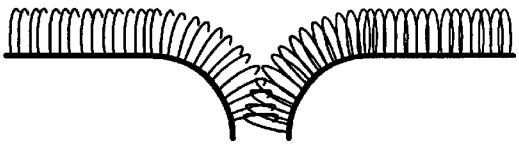
FIGS. 2C and 2D show a side view of surfaces having hook and loop material adhering to each other.
Figure 2D:
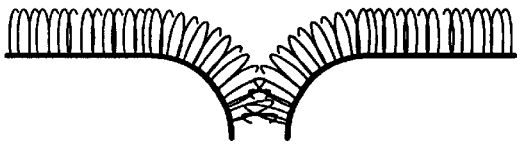
Figure 3A:
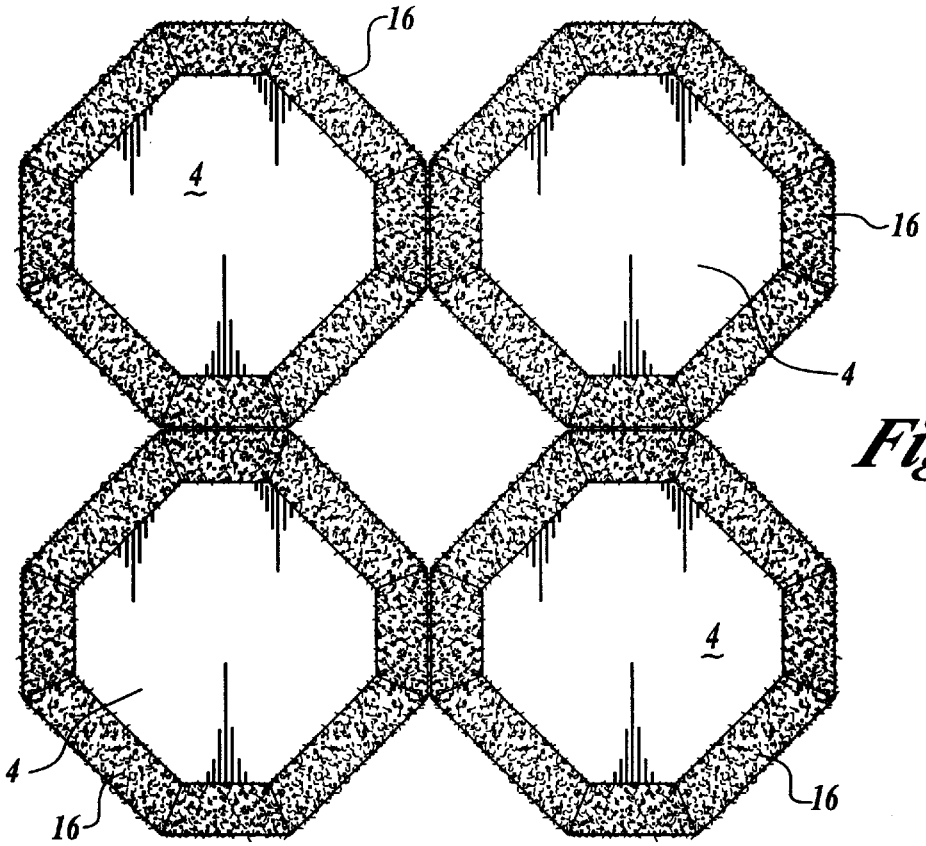
FIG. 3A shows a group of four throw pieces of the game of the present invention fastened together at the edge surfaces for use as a combined throw piece.
Figure 3B:
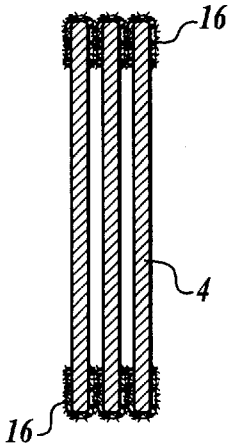
FIG. 3B shows a group of three throw pieces of the game of the present invention stacked together.

Referring to FIGS. 2A through 2D, an example to a throw piece 4 is shown. Throw piece 4 has an octagonal shape, but can be any one of the numerous geometrical shapes such as a star, sphere, square, etc. For illustrative purposes, an octagonal shape is used in this description as this particular shape can be thrown easily by "sailing" it on its side. Throw piece 4 comprises a panel 14 and a hook and loop material 16 on its outer edge. Hook and loop material is compatible with a similar hook and loop material on the target surface 6 which allows the throw piece 4 to adhere to the target surface 6 when the respective hook and loop surfaces contact. FIGS. 2C and 2D show the adherence or "mating" of two hook and loop surfaces such as that on the throw piece 4 and target surface 6 wherein the "hooks" of one surface grasp the "loops" of the other surface. FIG. 2C shows one surface being entirely hooks and the other surface loops, while FIG. 2D shows the two surfaces essentially identical, both having hooks and loops FIGS. 3A and 3B show throw pieces 4 combined for use in the game. FIG. 3A has a group of four throw pieces connected on two edge surfaces to each other to produce a "super" throw piece. FIG. 3B shows three throw pieces stacked together using the hook and loop surfaces to forma a stacked throw piece. Each of these "super" throw pieces can be used in variations of the game (which will be subsequently described in more detail) to add a strategic dimension to the game.

Figure 4A:
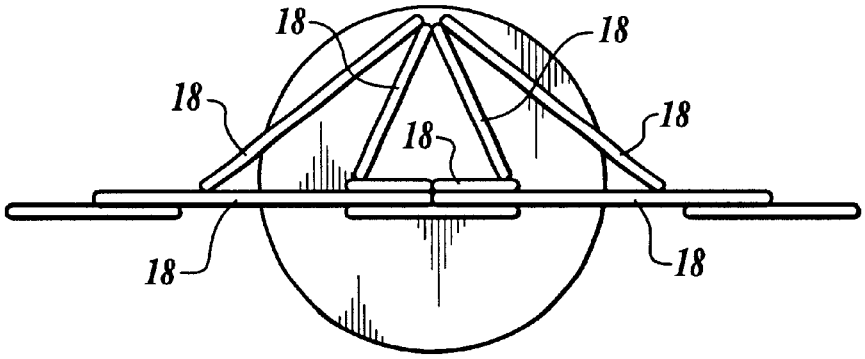
FIG. 4A shows a top view of an alternative embodiment having a target structure using an upright structural member and base member.
Figure 4B:
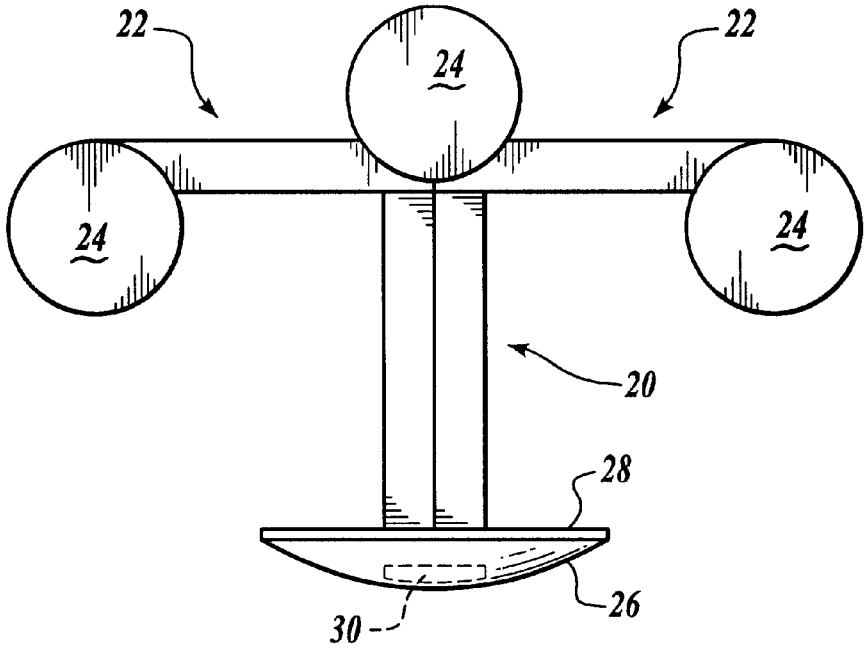
FIG. 4B shows a front view of an alternative embodiment having an upright target structure.

FIGS. 4A and 4B show an alternative embodiment of the game of the present invention which allows for a "tip over" target further advancing the creativity in the game. In this embodiment rectangular panels pieces referred to as boundary pieces previously, serve as a target and have hook and loop material on their surface so that the upright configuration shown can be formed by the players. A triangle shape of panels 18 is used (as best seen in FIG. 4A) to form a stable upright structural member designated generally as 20. Two horizontal panels 18 are placed on the upright structure 20 to allow for a target surface 22. The horizontal target surface 22 also has three circle target surfaces 24 attached thereto using the hook and loop surfaces, A variable and interesting target is thereby created. The circle target surfaces can be assigned a given point value either as a group or individually. Horizontal surfaces 22 can also be assigned different point values using marker pieces 10 (not shown) which adds to the interest of the game. The upright structure 20 is attached to a "bowl shaped" base 26. The base 26 has a lid 28 with a hook and loop surface allowing attachment of the upright structural marker thereto. The bowl shaped base 26 can have a weight 30 contained therein to act as a counterweight to the target preventing easy tipping of the target.

Figure 5A:
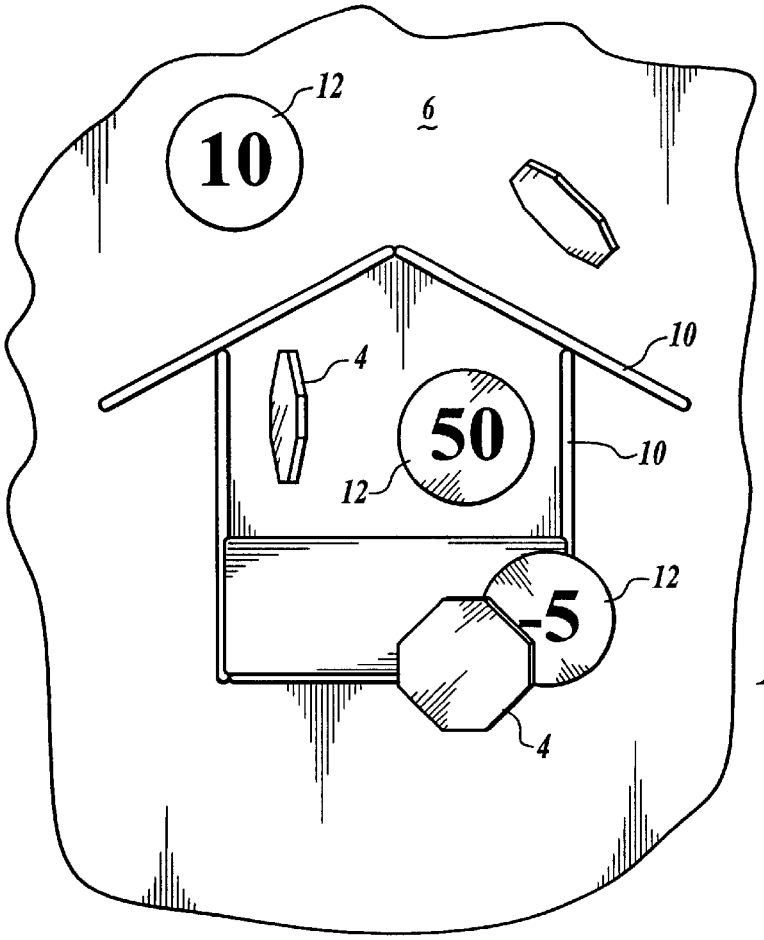
FIG. 5A is a front view of another embodiment of the game of the present invention showing a target shaped as a house.
Figure 5B:
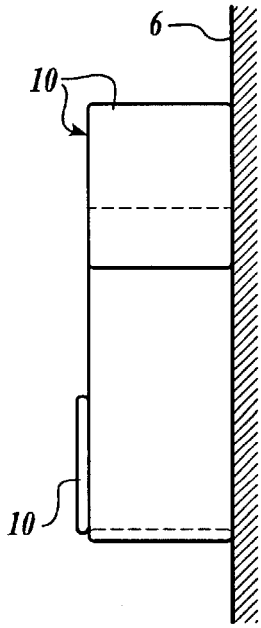
FIG. 5B is a side view of FIG. 5A.

FIGS. 5A and 5B show an alternative form of the present invention. In this embodiment, a target surface 6 is used having hook and loop material as previously described. Rectangular boundary structure pieces 10 (or panels 18) as described previously with hook and loop material on their edges are used to form a house-shaped target on the target surface. The target has zones marked by the marker pieces 12 shown in FIG. 5A. Throw pieces 4 are shown which have been aimed at the target.

In playing the game of the present invention, it can be appreciated that the game allows for a large degree of creativity by the players with respect to point values, target zones, and target shapes. Rules for a "static" target game will be described which can serve as a basis for other games. To set-up a static target game, FIGS. 1A and 1B can be used as a base reference. Initially, the players (which can be any convenient number) mutually agree on target zones using boundary pieces 10 which are placed in the predetermined pattern on target surface 6. In Figure 1B, one target or boundary zone is valued at 10 points by a marker piece 12, another target zone is valued at 50 points by a different marker piece 12 and yet another target zone designated with a point value of −5 by a third marker piece 12. After this set-up is completed, players throw a throw piece 4 to the target area in turn from a predetermined distance to determine who will throw first with the highest point count starting. Players with tied high scores can re-throw. Each player gets five throw pieces 4 and can only throw once per turn. It is possible to combine throw piece 4 as shown, for example, in FIGS. 3A and 3B, to risk a huge gain (or loss). The pieces thrown in this manner must be stuck together as one "super" piece. Players whose throw pieces touch each other and touch the target surface 6 cancel the scores for both throw pieces. If a player's throw piece sticks on top of another players throw piece without touching the surface 6, the player "steals" the opponents points from that piece thus effectively doubling the player's score from that piece. The player with the most points after all the throw pieces are thrown is the winner.

An example of rules for an upright target assembly as shown in FIGS. 4A and 4B can be submitted. This particular game can be referred to as the "tip-it-over" game. To set-up the game, players construct a target standing upright using panels 18 and base 26 as in FIGS. 4A and 4B with all players in agreement over the target. The upright structure of the target can be made taller if more than one panel 18 is connected in a vertical direction (not shown) resulting in a target which is easier to tip over due to a higher center of gravity. The game rules are as described in the "static target" game with the following exceptions. A player who dislodges a throw piece off the target surface with a hard throw is disqualified. The game is over if the target falls over or any part touches the ground. At this point, it can be noted that the target assembly of FIG. 4A and 4B can be floated in water by making the base assembly with a buoyant material. All players forfeit pieces not thrown when the target tips over. Points are added to determine a winner.

Additional game variations for either of the above described games include the following: A target is constructed without marking the target or boundary zones with a marker piece 12. Players throw piece 4 one at a time with the objective of grouping pieces in a given area. The player with the most pieces in a given target zone are permitted to throw the point markers to identify the scores. If a players throws a marker piece 12 and miss the target, the marker piece 12 will be re-thrown by the next player with the most pieces in an area. After all point marker pieces 12 are thrown, the scores are added and a winner determined.

The above pieces of the game which call for a hook and loop material on their surfaces can be covered with a bi-mating hook and loop material including what is commonly known as omni-tape which would be applied to the piece as common tape would.

In summary, the above described game in it various embodiments is a safe, challenging game suitable for all ages. The game can be carried and stored easily, especially if all the various pieces are stored on the target surface 6. The target surface 6 can then be folded and carried by handles 8 (FIG. 1).

The invention may be embodied in other forms without departing from the spirit of essential characteristics thereof. The present embodiments are, therefore, to be considered in all respects as illustrative and not restrictive the scope of the invention being indicated by the append claims rather than the foregoing description, and all change which comes within the meaning and range of equivalency of claims are intended to be embraced therein.

What I claim is:

1. A game for a plurality of players comprising a. A plurality of throw pieces, each throw being a panel with a hook and loop fabric attached thereto;

b. A target, said target consisting of a material adapted to receive said throw piece such that said throw piece adheres to the target upon striking the targets;

c. A plurality of boundary pieces, said boundary pieces adapted to adhere to said target so that at least one boundary zone may be formed on said target by the players arranging said boundary pieces in a predetermined shape; and d. A plurality of marker pieces, said marker pieces identifying a point value for each boundary zone formed by said boundary pieces, the location of said marker pieces determined by the players, whereby throw pieces within a given boundary zone are credited with the point value associated with the marker piece.

2. The game of claim 1 wherein each player is given more than one and less than ten throw pieces.

3. The game of claim 1 which includes a plurality of boundary zones, each of said boundary zones having a marker piece associated thereto, wherein said marker pieces are of different point values.

4. The game of claim 3 wherein at least one of said boundary zones has a marker piece associated thereto with a negative point value.

5. The game of claim 1 wherein said throw pieces are adapted to adhere to each other and a plurality of throw pieces adhering to each other may be thrown at said target at one time.

6. The game of claim 1 wherein a throw piece of one player striking and adhering to a throw piece of an opposing player already on the target is awarded the point value of the throw piece of the opposing player already on the target.

7. The game of claim 1 wherein a throw piece of one player partially adhering to a throw piece of an opposing player already on the target and partially adhering to the target disqualifies the point value of the throw piece of both players.

8. The game of claim 2 wherein the player having the highest total value of all throw pieces after all of said throw pieces are thrown at said target is declared the winner.

9. The game of claim 1 in which said target is constructed such that the target may be collapsed upon itself thereby reducing the space required for storage of said target.

10. The game of claim 9 where said target includes handles whereby said throw pieces, boundary pieces, and marker pieces can be carried within the surface of said target when said target is collapsed.

11. The game of claim 1 wherein said target includes an upright structural member having a target surface of hook and loop fabric.

12. The game of claim 11 wherein said target further includes a base structural member supporting said upright structural member, said base structural member containing material which acts as a counterweight preventing said target from tipping over where the target surface is struck with a throw piece.

13. The game of claim 12 wherein said base structural member has an upper surface covered with hook and loop fabric.

14. The game of claim 12 wherein said throw pieces can float in water.

15. The game of claim 11 wherein said upright structural member can be increased in length producing a taller target.

16. The game of claim 11 wherein said target is buoyant enough to float in water and is placed in a pool of water.

17. The game of claim 11 wherein a player whose throw piece knocks a previously thrown piece off the target is disqualified.

18. The game of claim 11 wherein the game is completed if a part of the said target surface touches the ground when a throw piece strikes it.

19. The game of claim 16 wherein the game is completed if a part of said target surface touches the water when a throw piece strikes it.

20. The game of claim 1 wherein the marker pieces are thrown by the players onto said target.

* * * * *